US006328756B1

(12) United States Patent
Amernick

(10) Patent No.: US 6,328,756 B1
(45) Date of Patent: Dec. 11, 2001

(54) PAD FOR PREVENTING AND/OR RETARDING THE APPEARANCE OF AND/OR FOR TREATING FACIAL WRINKLES, METHODS OF FORMING THE PAD, AND METHOD OF USING THE PAD

(76) Inventor: Hortense Amernick, 3509 Shelburne Rd., Baltimore, MD (US) 21208

( * ) Notice: Subject to any disclaimer, the term of this patent is extended or adjusted under 35 U.S.C. 154(b) by 0 days.

(21) Appl. No.: 09/484,220

(22) Filed: Jan. 18, 2000

Related U.S. Application Data

(63) Continuation of application No. 08/377,357, filed on Jan. 24, 1995, now abandoned.

(51) Int. Cl.[7] ..... A61F 5/08; A61F 13/00
(52) U.S. Cl. ..... 606/204.15; 604/304
(58) Field of Search ..... 602/40, 41; 604/204.15, 604/204.35; 128/859, 860, 861, 862

(56) References Cited

U.S. PATENT DOCUMENTS 2,256,197 * 6/1941 Laffin ..... 128/76
4,158,594 * 6/1979 Becker et al. ..... 162/112

* cited by examiner

*Primary Examiner*—Kim M. Lewis
(74) *Attorney, Agent, or Firm*—Connelly Bove Lodge & Hutz

(57) ABSTRACT

A pad for preventing and/or retarding the appearance of and/or for treating facial wrinkles and particularly wrinkles of the upper lip. The pad includes a plurality of segments of tissue stacked on top of each other. The segments have a longer dimension of from about one to about six inches and a shorter dimension of from about one-quarter to about three-quarters of an inch.

13 Claims, 1 Drawing Sheet

PAD FOR PREVENTING AND/OR RETARDING THE APPEARANCE OF AND/OR FOR TREATING FACIAL WRINKLES, METHODS OF FORMING THE PAD, AND METHOD OF USING THE PAD

CROSS-REFERENCE TO RELATED APPLICATION

This application is a continuation of U.S. patent application Ser. No. 08/377,357 filed Jan. 24, 1995 now abandoned.

FIELD OF THE INVENTION

The invention relates to devices for treating and/or preventing and/or retarding process of the wrinkling of a person's skin. In particular, the invention relates to a pad for placing inside a person's mouth, between the lips and/or cheeks and the gums to help treat and/or prevent and/or retard the process of wrinkling, especially around the person's mouth, and particularly the upper lip.

BACKGROUND OF THE INVENTION

In our appearance conscious society, people often judge others based upon physical appearance, including weight, hair style or existence, and skin appearance, among other things. This is especially true of women. To address concerns that they may be discriminated against based upon their appearance, people increasingly concentrate on improving or treating their outward appearance, particularly to conform to popular ideals of beauty. People make efforts an a variety of fronts to maintain a youthful appearance. For example, people diet, exercise, and take vitamins, among other things.

One of the most visible parts of a person's appearance is his or her face. Accordingly, people increasingly address perceived imperfections on the face. For instance, people have face lifts, or nose jobs or treat imperfections in the skin as a consequence of the appearance consciousness of our society.

As we age, wrinkles often appear in our skin. Wrinkles affect people most significantly when the wrinkles appear on the face since the face is often the part of the body that is usually exposed. Although this problem affects all people, wrinkles are especially worrisome for women, particularly as they approach and are in middle and/or old age, given the much greater emphasis on the maintenance of a youthful appearance of women in our society. Often, people treat wrinkles with lotions, creams, facial wraps, facial scrubs, facial massages, and other treatments, including prescription pharmaceuticals. Frequently, people turn to more drastic treatments that require administration by a physician. More drastic treatments include having materials, such as collagen, injected under the skin of the face or having plastic surgery performed.

Downsides of existing treatments for facial skin wrinkles, particularly the more drastic and risky procedures described above, include excessive time and cost and possible unknown and negative side effects. For instance, plastic surgery is quite costly and surgery always has associated risks. Also, it is known that the effects of collagen injected into, a person's lips, is temporary and, therefore, requires repetitive trips to a physician for retreatment. Also, compounds, such as RETIN-A have some harmful side effects.

SUMMARY OF THE INVENTION

The inventor of the present invention recognized the problems associated with existing treatments for facial wrinkles and developed the present invention to provide solutions to these problems.

Accordingly, one object as well as advantage of the present invention is to reduce the cost of treating facial wrinkles as compared to known treatments.

Another object and advantage of the present invention is to reduce or eliminate side effects associated with known treatments for facial wrinkles.

A further object and advantage of the present invention is to prevent and/or retard the appearance of and/or to provide a simple treatment for facial wrinkles.

In accordance with these and other objects, the present invention provides a pad for preventing and/or retarding the appearance of and/or for treating facial wrinkles. The pad includes a plurality of segments of tissue stacked on top of each other. The segments typically have a longer dimension of from about one to about six inches and a shorter dimension of from about one-quarter to about three-quarters of an inch.

According to other aspects, the present invention provides a method of making a pad for preventing and/or retarding the appearance of and/or for treating facial wrinkles. The method includes the steps of forming a pad from a plurality of layers of an absorbent material, and placing the pad in a mouth of a person between a gum and/or tooth or teeth and an inner surface of a cheek or lip of the person.

According to further additional preferred aspects, the present invention provides a method of preventing and/or retarding the appearance of and/or for treating facial wrinkles. The method includes the step of forming a pad from a plurality of layers of an absorbent material. The pad is placed into a mouth of a person between a gum and/or tooth or teeth and an inner surface of a cheek or lip of the person.

Still other objects and advantages of the present invention will become readily apparent those skilled in this art from the following detailed description. The detailed description shows and describes only the preferred embodiments of the invention, simply by way of illustration of the best mode contemplated of carrying out the invention. As will be realized, the invention is capable of other and different embodiments. The details of the present invention may be modified in various obvious respects, without departing from the invention. Accordingly, the drawings and description are to be regarded as illustrative in nature and not as restrictive.

DETAILED DESCRIPTION OF VARIOUS AND PREFERRED EMBODIMENTS OF THE INVENTION

Figure 1:
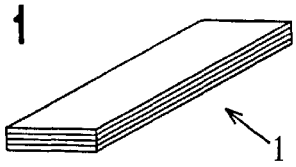
FIG. 1 represents a perspective view of one embodiment of a pad for preventing and/or retarding the appearance of and/or for treating facial wrinkles according to the present invention.

FIG. 1 shows a perspective view of an embodiment of a pad for preventing and/or retarding the appearance of and/or for treating facial wrinkles. The embodiment shown in FIG. 1 includes a plurality of layers of an absorbent material. Preferably, the absorbent material is facial or another type of tissue. However, other absorbent materials may also be used to form the pad. For instance, toilet tissue, among other materials, may also be used. Preferably, the absorbent material is also at least somewhat pliable so as to increase the user's comfort.

Some materials provide less favorable results than the results provided by the present invention. For example, cotton and gauze do not work as well as the tissue used according to the present invention. The tissue of the present invention was found by the inventor to provide unexpectedly favorable results both in functioning to prevent and/or retard the appearance of and/or for treating facial wrinkles. The inventor also discovered that tissue also provided unexpectedly good results regarding user comfort. Cotton and gauze and related products provide less overall comfort.

According to a preferred embodiment, a pad according to the present invention is formed from facial tissue. Facial tissue has been found to provide a pad more effective in preventing and/or retarding the appearance of and/or for treating facial wrinkles. Typically, facial tissue comprises a cellulosic web. Such webs may have a basis weight of from about 20 $g/m^2$ to about 60 $g/m^2$. However, facial tissue of any basis weight may be used. Those skilled in the art of facial tissue manufacture know how to form such webs.

More preferably, the facial tissue employed according to the present invention is SCOTTIES brand facial tissue manufactured by Scott Paper Company of Philadelphia, Pa. SCOTTIES brand facial tissue has a character which makes it easily adaptable to the contour of an individual's mouth and helps hold the pad firmly in position. One characteristic of SCOTTIES brand facial tissue that seems to be particularly important is its absorbency. Other characteristics that seem to make SCOTTIES brand facial tissue especially effective in the present invention include their ability to cause a pad formed from them to mold, conform, and/or dry to the shape of a person's mouth, including their teeth, gums, lips, and/or cheeks. Also, SCOTTIES brand facial tissue seems especially effective at not disintegrating and retaining its integrity. In an alternative embodiment, another type of tissue, facial or otherwise, may be used and then chemicals added or physical processes performed that would create tissue having properties similar to SCOTTIES brand facial tissue.

The embodiment of the pad shown in FIG. 1 has a width 1 of approximately one-half inch, a length of approximately 2 inches, and a thickness of approximately one-quarter inch. However, the pad may be formed in a variety of sizes. The size depends upon the application and characteristics of the person using the pad. For instance if the pad is placed at the front of the mouth, then the pad may be smaller than if placed toward the side of the user's mouth. Also, a person with a big mouth may require a bigger pad. The size of the pad may also vary depending upon the coverage within the mouth that a user desires. For example, the user may desire to cover parts of the mouth opposite the cheek and the lips simultaneously and therefore would require a longer pad.

Accordingly, a pad according to the present invention may have a width of from about one-quarter inch to about three-quarters of an inch, a length of from about one inch to about six inches, and a thickness of from about one-tenth of an inch to about one-half inch.

The layers making up the pad may be formed in a variety of ways. For instance, layers of the absorbent material to be used may be provided and then joined to form the pad. The layers do not necessarily require joining. For instance, the pad may be formed from the layers and then the pad placed in the user's mouth as described below.

The layers of absorbent material used to form such an embodiment may be formed in the dimensions of the desired length and width of the pad. The layers may then be stacked on top of each other to form the pad. Prior to placing the pad in the mouth, the layers may be joined. The joining may be accomplished by placing an adhesive material on one or both sides of the interior layers of the pad prior to stacking them. Preferably, the adhesive is a pharmaceutically acceptable material. Alternatively, the layers may be joined by placing a binding element about the stack of layers.

After forming the pad, whether the layers are bound together or not, the pad may be placed in the mouth of a user as described below.

In an alternative embodiment, the pad may be formed from a sheet of absorbent material. In such an embodiment, the sheet may be divided or folded to form the pad. According to one embodiment, the sheet of absorbent material may be cut into a plurality of segments. The segments may have the same length and width as the pad that is to be formed from the segments. The segments may then be stacked on top of each other and possibly joined together, as described above.

According to another embodiment, the sheet of absorbent material may be divided into a plurality of segments. The segments may have the same length and width as the pad that is to be formed from the sheet. The segments may be formed by scoring the sheet of material or otherwise marking the sheet. The sheet may then be folded along the scores or the line. The segments may or may not be joined together as described above. The finished pad may then be inserted into a users mouth as described below.

In still other embodiments, a series of pads may be formed and joined or separated by a series of perforations or the pads may be scored to allow them to be separated from each other. For example, extended sheets of tissue could be used to form the pad. The sheets of tissue could be stacked on top of each other or formed on top of each other. The plurality of sheets could then result in an extended pad having a thickness about the desired thickness of an individual pad according to the invention and a width about the desired longer dimension of a pad of the invention. The extended pad could then be scored or perforations could be formed in the pad. Individual pads could then be separated from the extended pad as required.

According to one embodiment of a method according to the present invention for forming pads for preventing and/or retarding the appearance of and/or for treating facial wrinkles from a sheet of absorbent material, a sheet is provided that is from about six to about ten inches long and from about one to about three inches wide. Preferably, the sheet is about eight inches long and about two inches wide. However, the size of the sheet may be varied to provide a pad giving the best fit and function for a particular user's mouth.

Figure 2:
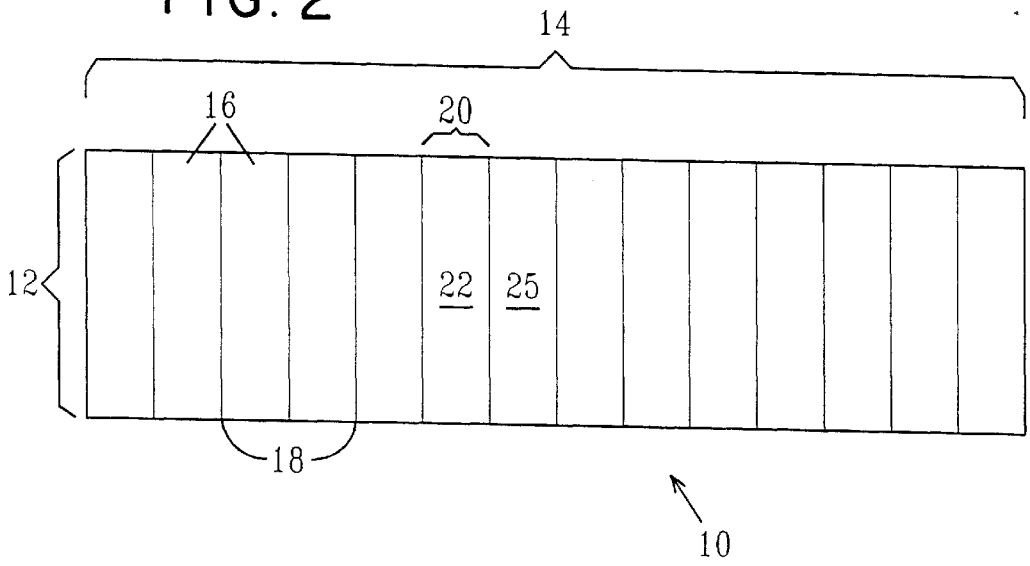
FIG. 2 represents an overhead view of an embodiment of a sheet of absorbent material from which a pad according to the present invention, such as the embodiment shown in FIG. 1, may be formed.

Referring to FIG. 2, the sheet 10 of absorbent material is divided into segments 16. The segments 16 may be formed, for instance, by forming divisions 18 in the sheet 10. Each division has a width 20 and a length 12. Preferably, the length 12 is the same as the width 20 of the sheet 10, as shown in FIG. 2. The width 20 of the sheet 10 may vary, depending upon the size of the segments 16. In the embodiment shown in FIG. 2, the sheet 10 is divided into a segments 16 such that each segment has the same width 20. Therefore, the width 20 of each segment 16 is equal to the length 14 of the sheet 10 divided by the number of segments formed. The width 20 of the segments may vary, depending upon the number of segments formed. Also, the segments 16 may all have different widths.

The divisions 18 in the sheet 10 may be formed by scoring the sheet of material, by perforating the sheet, or by drawing a line indicating the divisions between segments, among other methods. In the embodiment shown in FIG. 2, the sheet of absorbent material is divided into fourteen segments 1. Both the size and number of segments 16 may be varied to create a desired thickness of the pad. Also, depending upon the size of a particular user's mouth, the number of folds may be varied to adjust the thickness of the pad and, thus, give a more comfortable fit. The length, width, and thickness of the pad may also be varied as required to ensure the effectiveness of the pad. The size of the user's teeth and gums and the amount of stretching of the facial skin and muscles desired may also cause the size of the pad to be varied.

Figure 3:
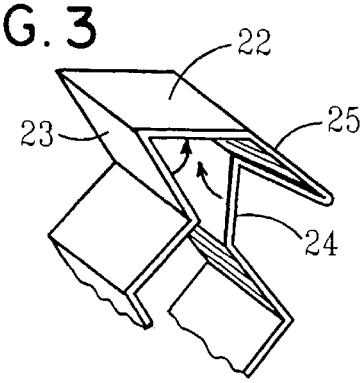
FIG. 3 represents a side view of the sheet of absorbent material shown in FIG. 2 in a partially folded condition.

Once the divisions 18 between the segments 16 are formed, the sheet of absorbent material may be folded to form the pad. The sheet 10 may be folded in a variety of ways. One preferred method of folding the sheet is shown in FIG. 3. FIG. 3 shows a partially folded sheet of material. According to this method, one segment will form the top of the pad. This segment is known as the top segment 22 shown in FIGS. 1 and 2.

Once identification of the top segment 22 has taken place, the segments of the sheet to the right and left of the top segment 22 are folded. According to the embodiment illustrated in FIG. 3, the sheet is folded accordion-style. Other methods of folding may also be used. The segments to the left of the top segment, as shown in FIG. 3, are first folded under the top segment. According to this embodiment, the surface of the segment 23 adjacent the top segment 22 is adjacent the bottom surface of the top segment 22.

Next, the third segment 24 to the right of the top segment, as shown in FIG. 3, is folded under the top segment. Then, the two segments between the top segment 22 and the segment 24 are folded under the segment 24 such that the surface of the segment 25 adjacent the top surface of the top segment faces downwardly, as shown in FIG. 3, away from the top segment. The remaining segments to the right of the top segment are then folded accordion-style under the pad.

The method illustrated in FIG. 3 is only one method of folding a sheet of absorbent material according to the present invention to form a pad according to the present invention. The sheet may also be folded in a variety of ways to obtain a pad of the desired length, width, and thickness.

Figure 4:
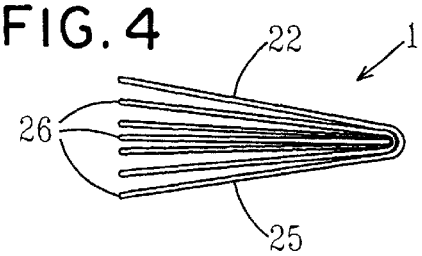
FIG. 4 represents a side view of an embodiment of a folded pad formed from the sheet shown in FIG. 2.

FIG. 4 shows a pad 1 which has been formed from a sheet folded according to the method described above and shown in FIG. 3. The pad shown in FIG. 4 includes a plurality of leaves 26 formed by the folding of the sheet 10.

Other embodiments of the pad may not include a sheet of absorbent material. A pad of such material may not include individually defined layers of sheet material. Therefore, such embodiments may also be formed according to a different method than the above-described method. For example, a mass of material having the length, width, and thickness of the desired pad, either before or after compaction as would occur in a user's mouth, may be provided.

The present invention may be formed by hand from, for instance, a sheet of facial tissue. The pad may also be formed by hand from other fibrous absorbent materials, such as toilet tissue. Other absorbent materials may also be used. However, facial tissue has been found to provide superior results for preventing and/or retarding the appearance of and/or for treating facial wrinkles.

A pad according to the present invention may also be formed according to a manufacturing process. The manufactured pad may be a folded pad similar to the hand made pad or may be mechanically layered to the required thickness with or without the leaves of the hand made pad. A mechanically layered pad could be formed in about the size of one of the segments of a pad formed by folding a sheet of absorbent material as described above. Such a pad could be about two inches long and about half an inch wide. One skilled in the art could make the tissue pad according to a variety of known manufacturing processes.

Figure 5:
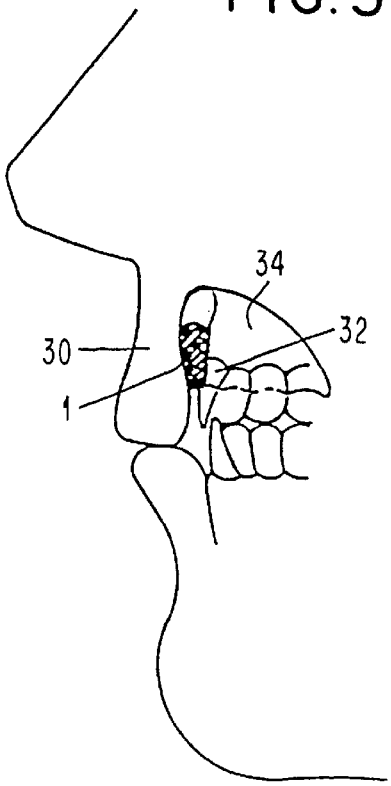
FIG. 5 represents a perspective view of an embodiment of a pad according to the present invention placed between a person's gums and teeth and an inner surface of their mouth opposite their upper lip.

In addition to the above-described pad and method of forming it, the present invention also includes a method of preventing and/or retarding the appearance of and/or for treating facial wrinkles. Regardless of how the pad of the invention is formed, according to a method of the present invention, the pad may be placed in a user's mouth, between the user's teeth and/or gums and the inside surface of the user's mouth, opposite the lips, cheeks and/or any other part of the user's mouth. For instance, a pad 1 according to the invention could be placed between the user's upper lip 30 and teeth 32 and gums 34 as shown in FIG. 5. However, preferably, the pad is inserted anywhere in the user's mouth opposite where the user desires to prevent and/or retard the appearance of and/or treat facial wrinkles. For example, a pad according to the invention may be inserted into a person's mouth in a manner and/or position similar to an appliance for treating temporomandibular joint disorder. The pad is inserted to the desired degree and in the desired location and, preferably, is left there overnight. However, the pad may be used at any time of day for any period of time.

The period of time that a device according to the invention remains in a user's mouth may be sufficient to retard and/or prevent and/or treat wrinkle formation. In the context of the invention, retardation of the formation of wrinkles may mean that the time that wrinkles appear in a user's skin may be delayed. Also, retardation may mean that the time required for a wrinkle to deepen, grow longer and grow wider may be extended.

If the pad is similar to the embodiment shown in FIG. 4, then when placing the pad between the user's gum and lip, the leaves 26 should be directed away from the direction that the pad is inserted to help ensure that the pad is not pushed apart by the interior surfaces of the user's mouth as the pad is inserted. Over time, the pad tends to conform to the shape of the interior surfaces of the mouth that the pad contacts. For example, the pad may at least partially conform to the shape of at least a portion of the surface of the user's gums and/or teeth and/or at least a portion of the inner surface of the user's cheeks and/or lips.

Preferably, each pad is only used once and a fresh pad according to the present invention is placed in the user's mouth each evening and be worn for the entire night to relieve tension, puckering or other distortions in the facial skin and/or muscles, and, thus, prevent and/or retard and/or treat wrinkles and/or the wrinkling process. Upon regular use of pads of the present invention according to the method of the invention, a "muscle memory" may be created. This muscle memory may help to prevent wrinkles from forming in the facial muscles since the muscles will tend to stay in the "remembered" position. The muscle memory may also help to relieve tension in the user's upper lip and other parts of the user's face while the user is awake.

In this disclosure, there is shown and described only the preferred embodiments of the invention, but, as aforementioned it is to be understood that the invention is capable of use in various other combinations and environments and is capable of changes or modifications within the scope of the inventive concept as expressed herein.

What is claimed is:

1. A method of performing at least one function selected from the group consisting of preventing the appearance of facial wrinkles, retarding the appearance of facial wrinkles, and treating facial wrinkles, said method comprising:

a) obtaining a pad from a stack of a plurality of layers of tissue wherein said tissue is selected from the group consisting of facial tissue and toilet tissue; and wherein said pad comprises a plurality of layers of said tissue; and b) placing said pad in a mouth of a person between at least a portion of gums and at least a portion of an inner surface of a cheek or lip of the person; and wherein said pad at least partially conforms to the shape of interior surface of said mouth that is contacted by said pad due to being placed in the mouth of said person.

2. A method according to claim 1, wherein said pad has a longer dimension of from about one to about six inches and a shorter dimension of from about one-quarter to about three-quarters of an inch.

3. A method according to claim 1, wherein said pad is inserted between at least a portion of the gums and at least a portion of an upper lip of the person.

4. A method according to claim 1, wherein said pad is formed by folding a sheet of tissue.

5. A method according to claim 1, wherein said plurality of layers are formed by forming a stack of segments of tissue.

6. A method according to claim 5, wherein said segments are provided by forming a plurality of folds in a sheet of tissue, thereby dividing said sheet of tissue into a plurality of segments, said sheet of tissue having a longer dimension of from about six to about ten inches and a shorter dimension of from about one to about six inches, and forming said pad by folding said sheet of tissue along said folds, said pad having a length and a width approximately equal to a length and a width of one of said segments, and said pad having a thickness approximately equal to a thickness of said segments stacked on top of each other.

7. A method according to claim 1, wherein said segments are provided by forming a sheet of tissue having a longer dimension of about eight inches and a shorter dimension of about two inches, dividing said sheet of tissue into fourteen equal segments by forming folds in said sheet of tissue and forming said pad by folding said sheet of tissue along said folds, said pad having a length and width approximately equal to a length and a width of one of said segments, and said pad having a thickness approximately equal a thickness of said fourteen segments stacked on top of each other.

8. A method according to claim 1, wherein said stack is provided by mechanically layering said segments of tissue until said stack has a thickness which is approximately equal to the total thickness of fourteen layers of tissue, said pad having a longer dimension of about two inches and a shorter dimension of about one-half inch.

9. The method of claim 1 wherein said tissue is facial tissue.

10. The method of claim 9 wherein the facial tissue has a basis weight of about 20 $g/m^2$ to about 60 $g/m^2$.

11. The method of claim 10 wherein the facial tissue is Scotties brand facial tissue.

12. The method of claim 1 wherein the pad remains in the mouth of the person overnight.

13. The method of claim 1 which further comprises discarding said pad after a single use and repeating the method.

* * * * *